US008066050B2

(12) United States Patent
Lin

(10) Patent No.: US 8,066,050 B2
(45) Date of Patent: Nov. 29, 2011

(54) ROMAN CURTAIN

(76) Inventor: Shih-Ming Lin, Chiayi Hsien (TW)

( * ) Notice: Subject to any disclaimer, the term of this patent is extended or adjusted under 35 U.S.C. 154(b) by 76 days.

(21) Appl. No.: 12/696,214

(22) Filed: Jan. 29, 2010

(65) Prior Publication Data

US 2011/0186240 A1 Aug. 4, 2011

(30) Foreign Application Priority Data

Nov. 12, 2009 (TW) ..... 98138445 A

(51) Int. Cl.
*A47H 5/00* (2006.01)

(52) U.S. Cl. ..... 160/84.04; 160/170

(58) Field of Classification Search ..... 160/84.04, 160/84.01, 170, 171, 264
See application file for complete search history.

(56) References Cited

U.S. PATENT DOCUMENTS 1,789,724 A * 1/1931 Carver ..... 160/84.01
2,110,983 A * 3/1938 Carver ..... 160/84.04
2,260,101 A * 10/1941 De Falco ..... 160/84.04
3,777,800 A * 12/1973 Susoev ..... 160/84.04
3,817,309 A * 6/1974 Takazawa ..... 160/84.01
4,909,298 A * 3/1990 Langhart et al. ..... 160/178.1 R
4,934,435 A * 6/1990 Regev ..... 160/84.04
5,597,027 A * 1/1997 Simon et al. ..... 160/168.1 R

* cited by examiner

*Primary Examiner* — David Purol

(57) ABSTRACT

A roman curtain includes a curtain unit and a winding unit. The curtain unit has a covering portion, a top edge portion of which is adapted to be mounted to or in the vicinity of an upper edge of the window and which extends downwardly, an upper tube that is disposed on a rear side of the covering portion, a lower tube that is disposed on the rear side of the covering portion below and spaced apart vertically from the upper tube, and two rods that extend into the upper and lower tubes respectively. The winding unit has a winding rod that is adapted to be mounted rotatably to or in the vicinity of the upper edge of the window, and a winding piece, a top end portion of which is connected to the winding rod.

8 Claims, 15 Drawing Sheets

ROMAN CURTAIN

CROSS REFERENCE TO RELATED APPLICATIONS

This application hereby claims foreign priority benefits under 35 U.S.C. 119(a)-(d) or (f), or 365(b) of Taiwanese patent application number 098138445, filed Nov. 12, 2009, entitled "ROMAN CURTAIN".

BACKGROUND OF THE INVENTION

1. Field of the Invention

The present invention relates to a roman curtain, more particularly to a roman curtain that is simple in structure and safe.

2. Description of the Related Art

FIG. 1 shows a conventional roman curtain which includes a curtain cloth 11, a plurality of guide rings 12, and a plurality of cords 13. The guide rings 12 are disposed on one side of the curtain cloth 11. The cords 13 are vertically disposed on said one side of the curtain cloth 11, and extend through the respective guide rings 12. Bottom portions of the cords 13 are connected to a lower portion of the curtain cloth 11 or to lowermost guide rings 12.

When the curtain is in use, the curtain cloth 11 may be extended downwardly or folded in a layer-by-layer manner by manipulation of the cord 13. However, the conventional roman curtain has a complicated structure and is high in cost. Moreover, the curtain cloth 11 of the conventional roman curtain is not easily removed for cleaning or replacement. In addition, strangling injury may occur between the cord 13 and the curtain cloth 11.

SUMMARY OF THE INVENTION

Therefore, the object of the present invention is to provide a roman curtain which is safe, allows for convenient cleaning and replacement, and is low in cost.

Accordingly, a roman curtain of the present invention comprises a curtain unit and a winding unit.

The curtain unit has a covering portion a top edge portion of which is adapted to be mounted to or in the vicinity of an upper edge of the window and which extends downwardly, an upper tube that extends horizontally and that is disposed on a rear side of the covering portion, a lower tube that extends horizontally and that is disposed on the rear side of the covering portion below and spaced apart vertically from the upper tube, and two rods that extend into the upper and lower tubes respectively. The upper tube is formed with an upper slot.

The winding unit has a winding rod that extends horizontally and that is adapted to be mounted rotatably to or in the vicinity of the upper edge of the window, and a winding piece a top end portion of which is connected to the winding rod. The winding piece is able to be wound around the winding rod to be shortened, and unwound from the winding rod to be lengthened and to extend downwardly along or next to the rear side of the covering portion of the curtain unit. The winding piece extends through the upper slot from the winding rod and a bottom end portion of the winding piece is restricted in upward movement relative to the lower tube.

When the winding rod is rotated to thereby wind the winding piece therearound, the lower tube is moved upwardly together with the bottom end portion of the winding piece until the lower tube abuts against the upper tube, thereby folding the covering portion of the curtain unit.

BRIEF DESCRIPTION OF THE DRAWINGS

Other features and advantages of the present invent ion will become apparent in the following detailed description of the preferred embodiments with reference to the accompanying drawings, of which.

DETAILED DESCRIPTION OF THE PREFERRED EMBODIMENTS

Figure 1:
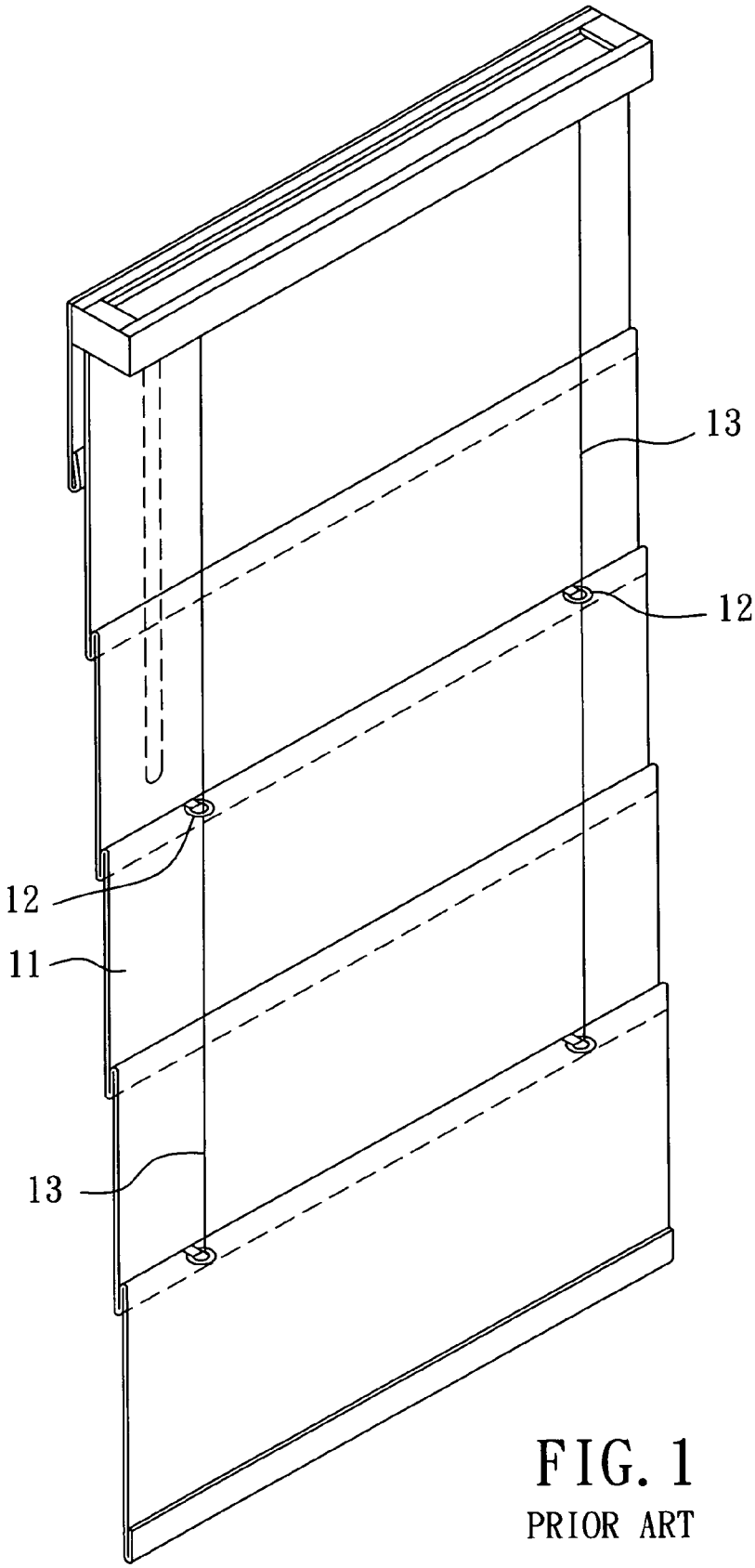
FIG. 1 PRIOR ART
FIG. 1 is a perspective view of a conventional roman curtain.

Before the present invention is described in greater detail, it should be noted that like components are assigned the same reference numerals throughout the following disclosure.

Figure 2:
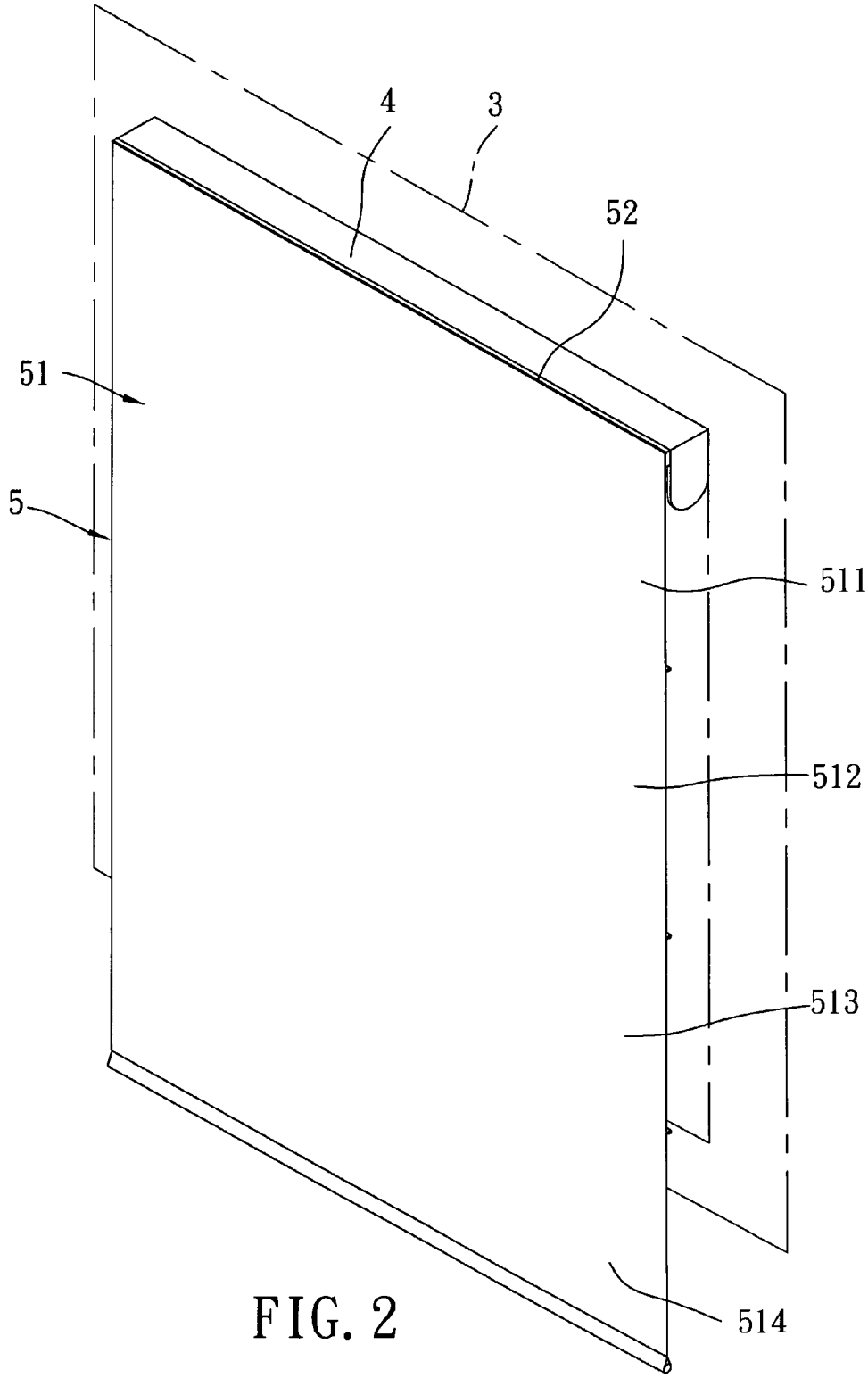
FIG. 2 is a front perspective view of a roman curtain according to a first preferred embodiment of the present invention.
Figure 3:
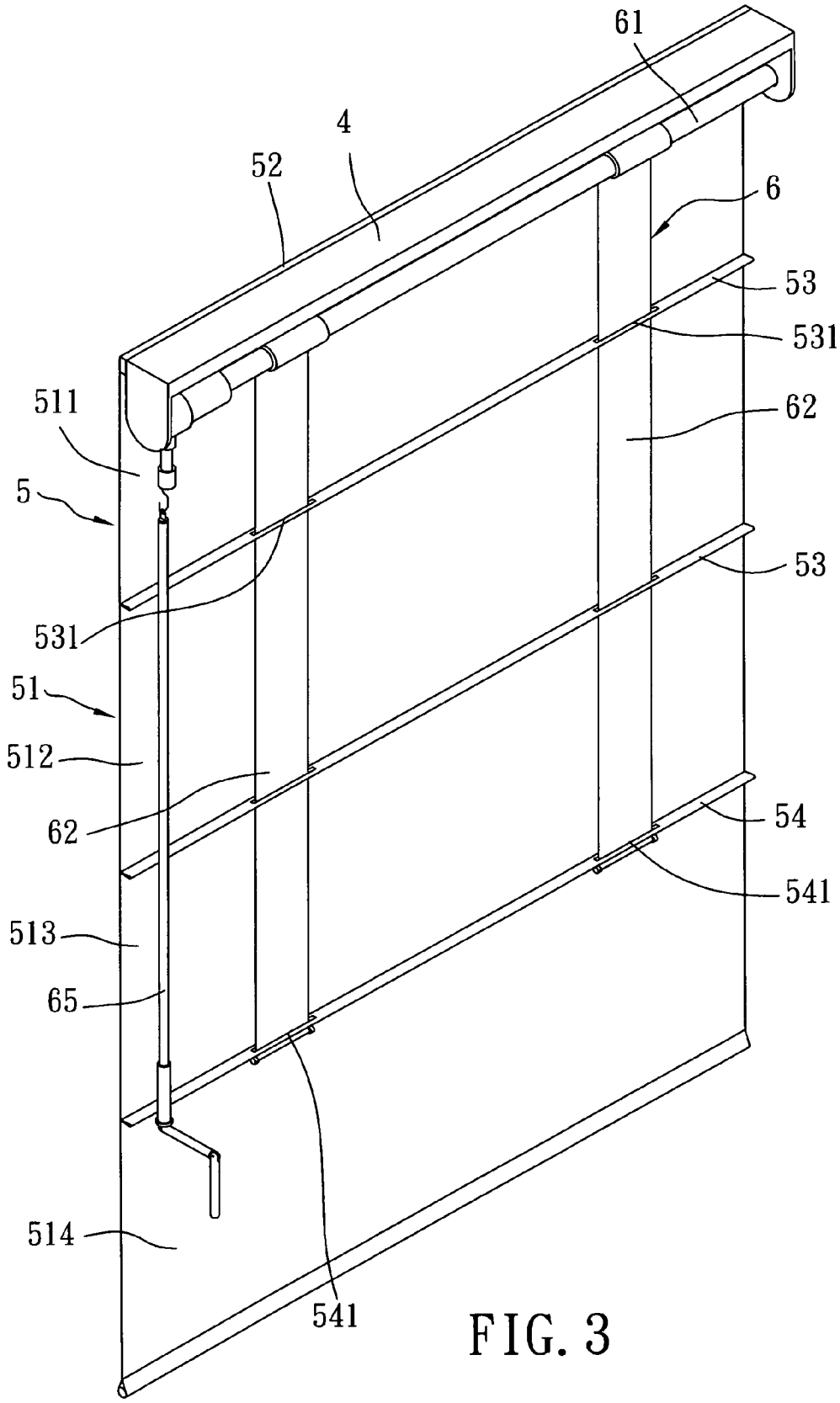
FIG. 3 is a rear perspective view of the roman curtain of the first preferred embodiment.
Figure 4:
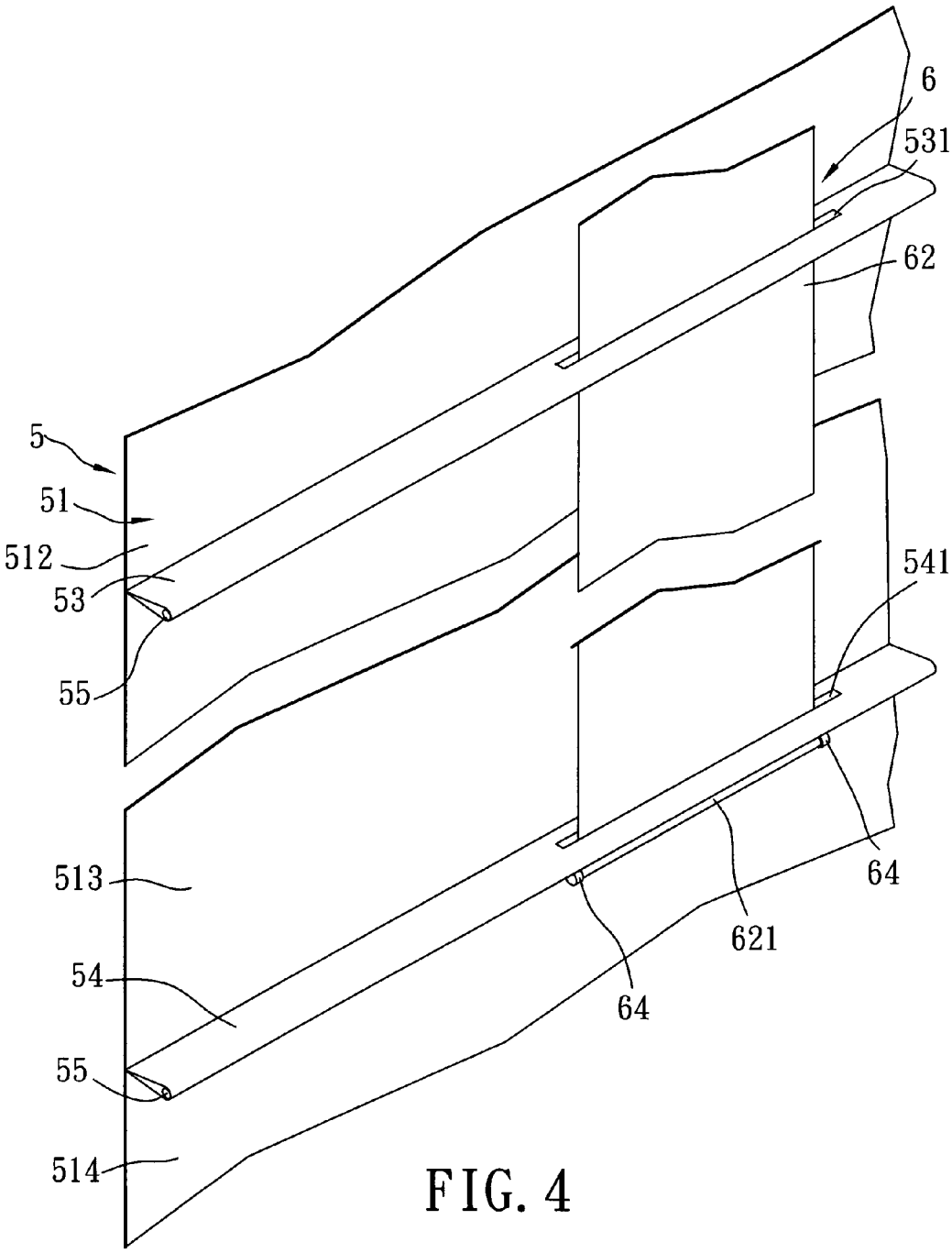
FIG. 4 is a fragmentary perspective view of the roman curtain of the first preferred embodiment.

Referring to FIGS. 2 to 4, a first preferred embodiment of a roman curtain according to the present invention is adapted for being mounted to a window 3. The roman curtain comprises a horizontal frame 4 mounted horizontally to an upper edge of the window 3, a curtain unit 5 connected to the horizontal frame 4, and a winding unit 6 disposed in back of the curtain unit 5.

The curtain unit 5 has a covering portion 51, a fastening member 52, two upper tubes 53, a lower tube 54, and three rods 55.

A top edge portion of the covering portion 51 is adapted to be mounted to or in the vicinity of an upper edge of the window 3, and the covering portion 51 extends downwardly.

The fastening member 52 interconnects the horizontal frame 4 and the top edge portion of the covering portion 51. For instance, the horizontal frame 4 may be made of a fabric material, the fastening member 52 may be a hook fastener, such as that found in a Velcro® fastener, and the fastening member 52 may attach to the fabric material of the horizontal frame 4 through a hook-and-loop engagement with the horizontal frame 4.

Each of the upper tubes 53 extends horizontally and is disposed on a rear side of the covering portion 51. The upper tubes 53 are spaced apart from each other. The lower tube 54 extends horizontally, and is disposed on the rear side of the covering portion 51 below and spaced apart vertically from the lower one of the upper tubes 53. The three rods 55 extend into the upper tubes 53 and the lower tube 54, respectively.

In this embodiment, the covering portion 51 has a first cloth segment 511, a second cloth segment 512, a third cloth segment 513, and a fourth cloth segment 514.

The upper tubes 53 are spaced apart vertically from each other as mentioned above. One of the upper tubes 53 is disposed between the first cloth segment 511 and the second cloth segment 512, and the other one of the upper tubes 53 is disposed between the second cloth segment 512 and the third cloth segment 513. Each of the upper tubes 53 is formed with two upper slots 531 that are spaced apart horizontally from each other and that extend horizontally. The lower tube 54 of the curtain unit 5 is disposed between the third cloth segment 513 and the fourth cloth segment 514, and is formed with two lower slots 541 that are spaced apart horizontally from each other and that extend horizontally.

In this embodiment, there are two of the upper tubes 53 as described above. However, there may be a greater number of the upper tubes 53, depending on the size of the covering portion 51 of the curtain unit 5 and other factors.

Figure 5:
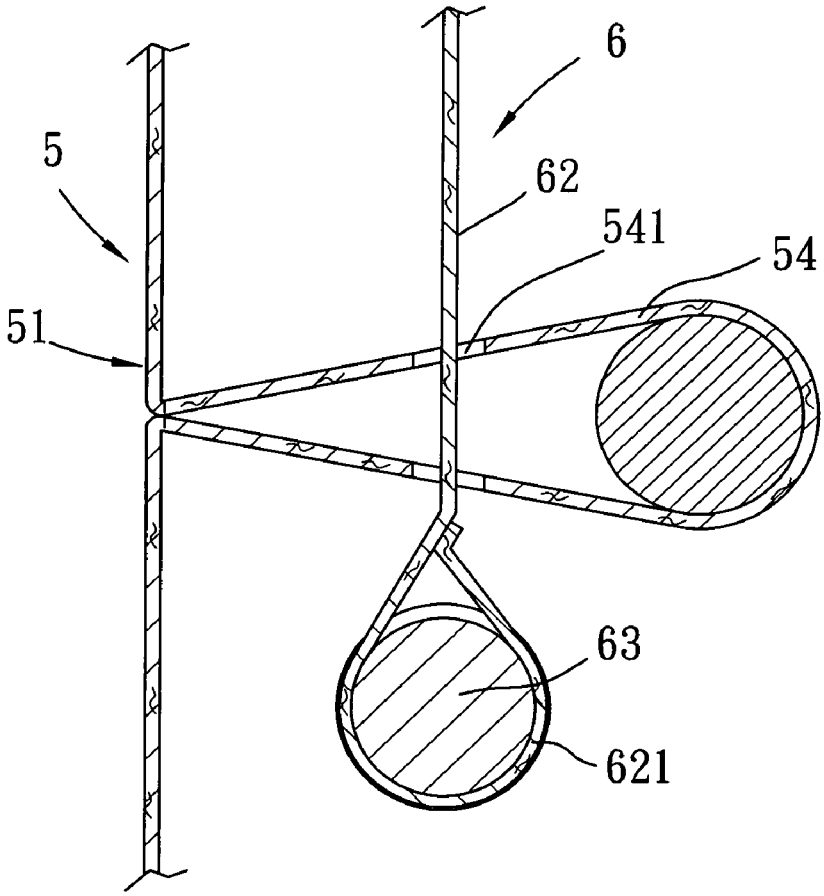
FIG. 5 is a fragmentary sectional side view of the roman curtain of the first preferred embodiment.

Referring to FIGS. 3 to 5, the winding unit 6 has a winding rod 61, two winding pieces 62, two abutting rods 63, four covers 69, and a control rod 65.

The winding rod 61 extends horizontally, and is adapted to be mounted rotatably to or in the vicinity of the upper edge of the window 3. In this embodiment, the winding rod 61 is mounted rotatably to the horizontal frame 4.

A top end portion of each winding piece 62 is connected to the winding rod 61. Each winding piece 62 is able to be wound around the winding rod 61 to be shortened, and unwound from the winding rod 61 to be lengthened and to extend downwardly along or next to the rear side of the covering portion 51 of the curtain unit 5.

Each of the abutting rods 63 is mounted horizontally and removably to or in the bottom end portion of a respective one of the winding pieces 62, is larger than the lower slots 541, and abuts against a bottom surface of the lower tube 54.

Two of the covers 64 are used for covering end portions of each of the abutting rods 63.

The control rod 65 is connected to the winding rod 61 in such a manner that the winding rod 61 can be rotated by manipulation of the control rod 65. In this embodiment, manipulation of the control rod 65 to rotate about its axis results in rotation of the winding rod 61 to rotate about its own axis. Also, in this embodiment, the axis of the winding rod 61 is roughly perpendicular to the axis of the control rod 65 when the control rod 65 hangs freely downward from its connection to the winding rod 61.

Figure 6:
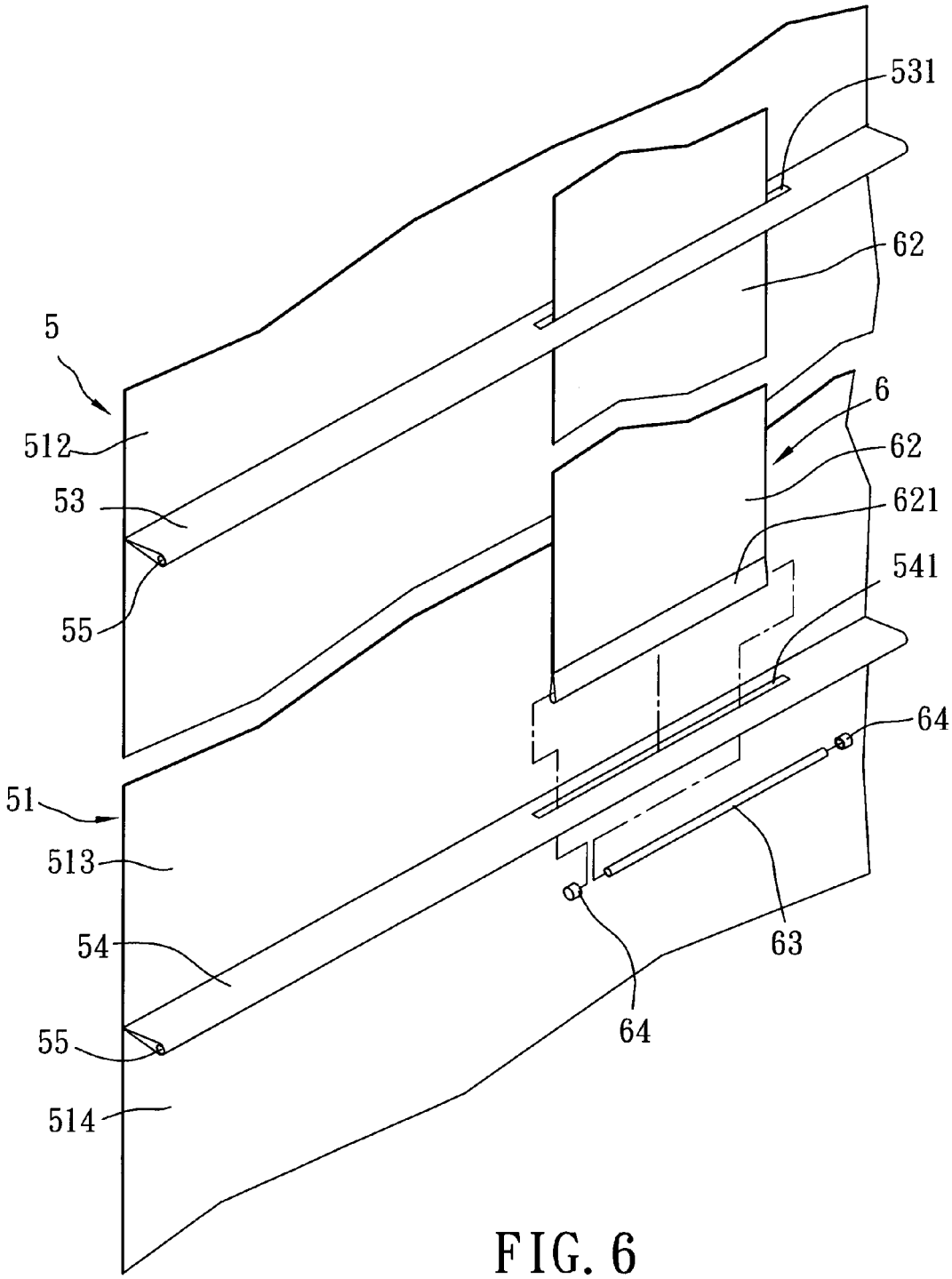
FIG. 6 is a fragmentary exploded perspective view of the roman curtain of the first preferred embodiment.

Referring to FIGS. 3, 5, and 6, in this embodiment, the bottom end portion of each of the winding pieces 62 is wound into a tube portion 621, and one of the abutting rods 63 is inserted into the tube portion 621. The outer diameter of each of the covers 64 is greater than the diameter of each of the tube portions 621, such that each of the abutting rods 63 is confined within the respective tube portion 621 when the respective covers 64 are disposed on the abutting rod 63. Through this configuration, each of the abutting rods 63 is connected removably to the bottom end portion of the respective winding piece 62. The manner in which the abutting rod 63 is connected to the bottom end portion of the respective winding piece 62 is not limited to the aforesaid configuration.

Figure 7:
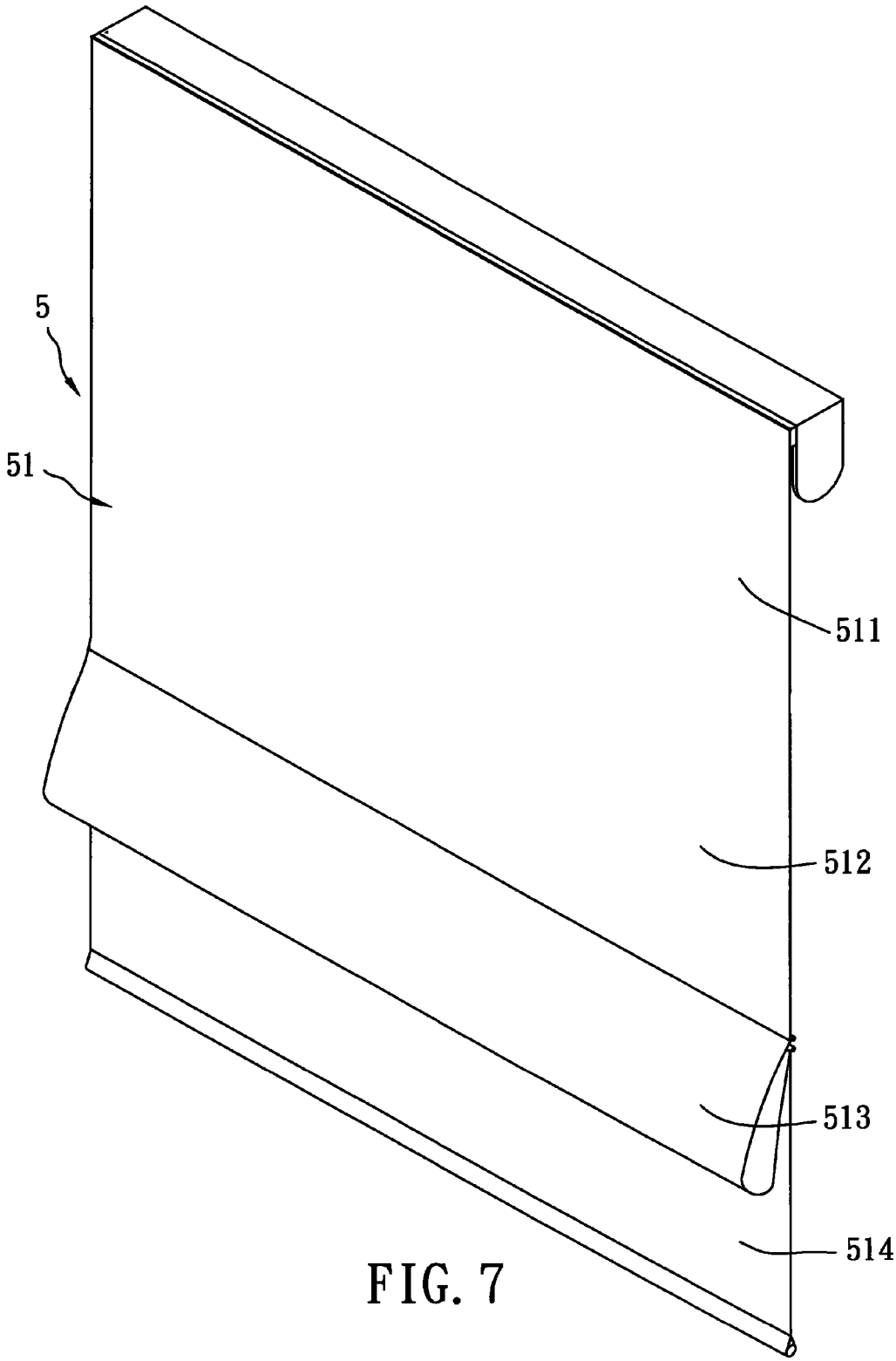
FIG. 7 is a view similar to FIG. 2, but illustrating a third cloth segment of a curtain unit in a folded state.

Each of the winding pieces 62 extends through the respective upper and lower slots 531, 541 from the winding rod 61. The bottom end portion of each winding piece 62 is restricted in upward movement relative to the lower tube 54. When the winding rod 61 is rotated to thereby wind the winding pieces 62 therearound, the lower tube 54 is moved upwardly together with the bottom end portions of the winding pieces 62 until the lower tube 54 abuts against the lower one of the upper tubes 53, thereby folding the covering portion 51 of the curtain unit 5, as shown in FIG. 7. That is, the third cloth segment 513 of the covering portion 51 is folded upwardly through such an operation. With continued rotation of the winding rod 61, the covering portion 51 is eventually folded fully upwardly, as shown in FIG. 8.

Figure 8:
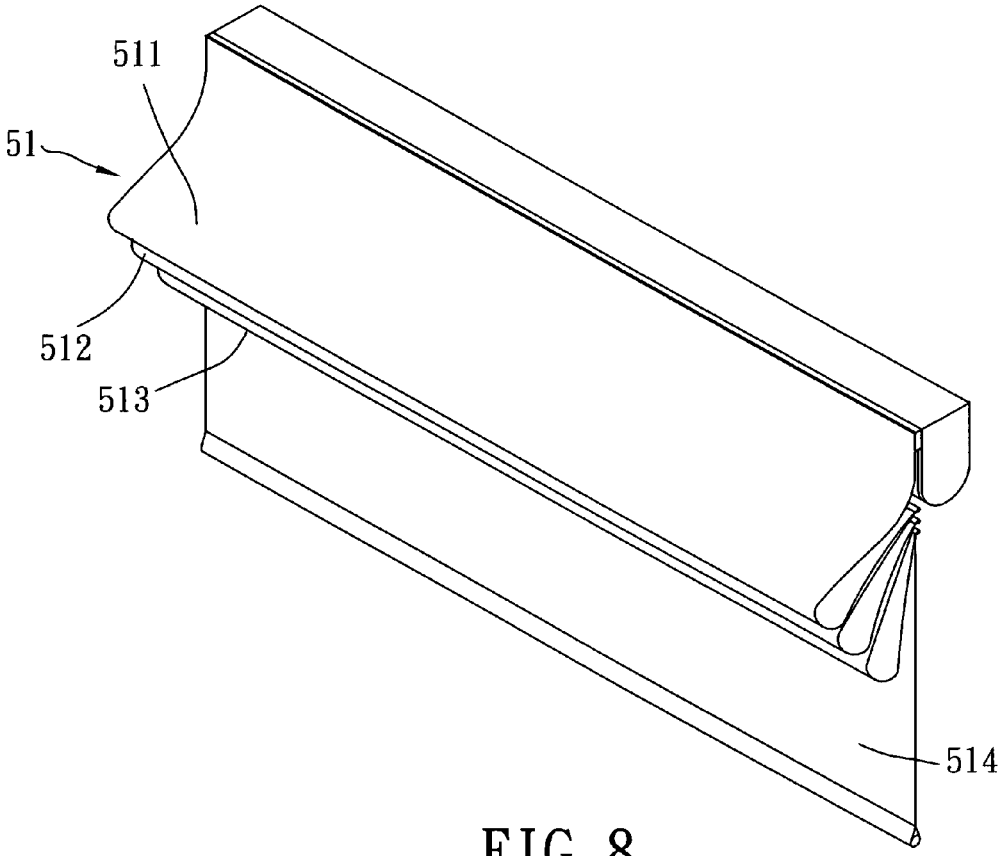
FIG. 8 is a view similar to FIG. 7, but illustrating the curtain unit in a fully folded state.

Referring to FIGS. 3, 4, and 8, it is noted that the upper tubes 53 and the lower tube 54 of the curtain unit 5 are pulled up and released to displace downwardly by manipulation of the winding pieces 62, rather than a cord as in the conventional roman curtain. This way, strangling injury occurring, for example, when the cord of the conventional roman curtain wraps around a child's neck may be avoided.

In addition, by simply removing the abutting rods 63, the winding pieces 62 can be removed from the upper and lower slots 531, 541, and the fastening member 52 can be separated from the horizontal frame 4 so that the covering portion 51 of the curtain unit 5 can be removed for cleaning, or for replacement with another covering portion 51 with a different style. Each of the winding pieces 62 may also be removed for cleaning or replacement. Hence, such removal of the covering portion 51 is very simple. Also, such a structure is simple, ultimately resulting in a lower cost for the roman curtain of the present invention.

Additional embodiments will now be described. To simplify the description of each of the embodiments to follow, the following preferred embodiments are shown and described as if there is only one winding piece 62 and one abutting rod 63 associated therewith, one upper tube 53, and one lower tube 59. However, in practice, each of the embodiments to follow includes two winding pieces 62 and two abutting rods 63 associated respectively therewith, two upper tubes 53, and one lower tube 54, as in the first preferred embodiment.

Figure 9:
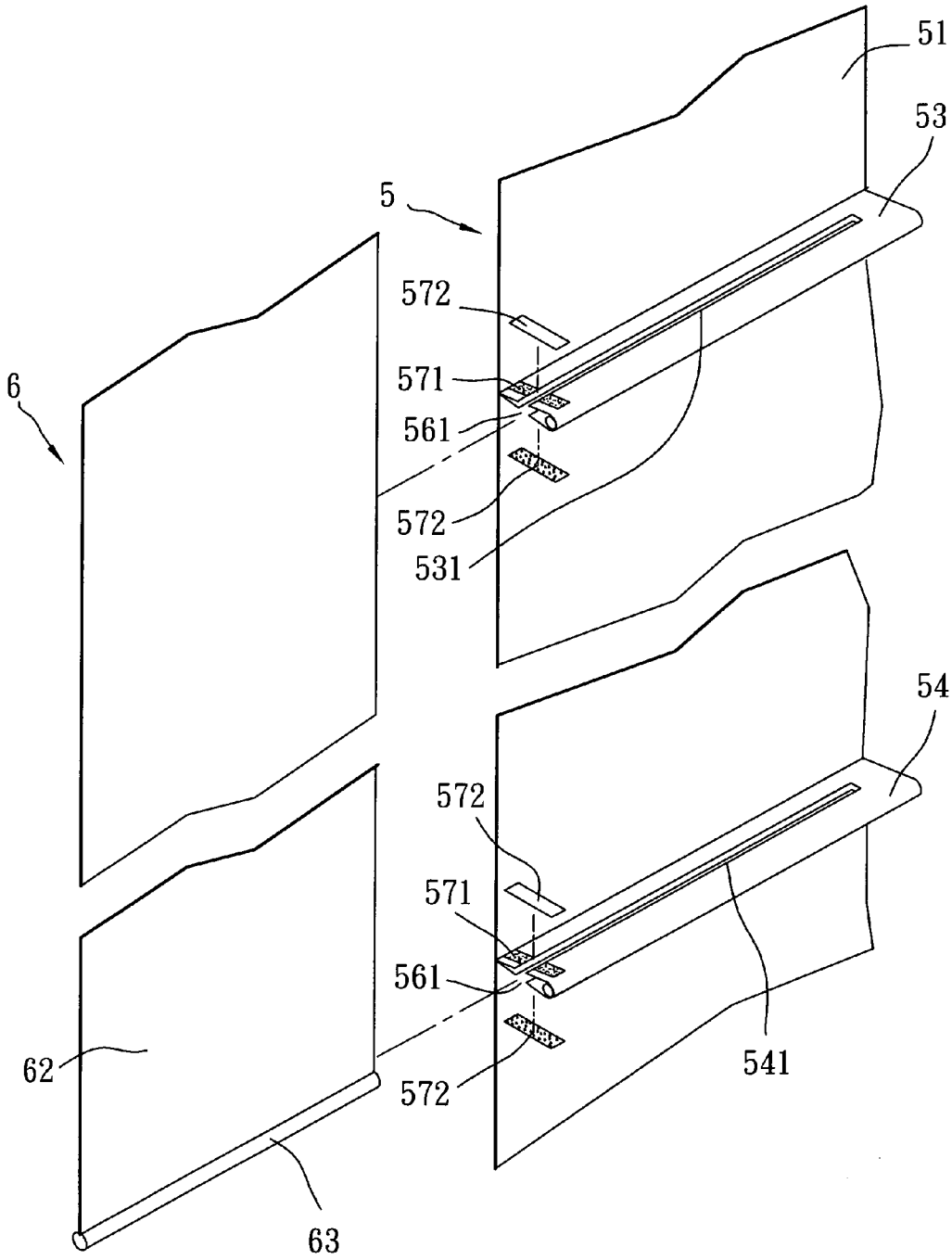
FIG. 9 is a fragmentary exploded perspective view of a roman curtain according to a second preferred embodiment of the present invention.
Figure 10:
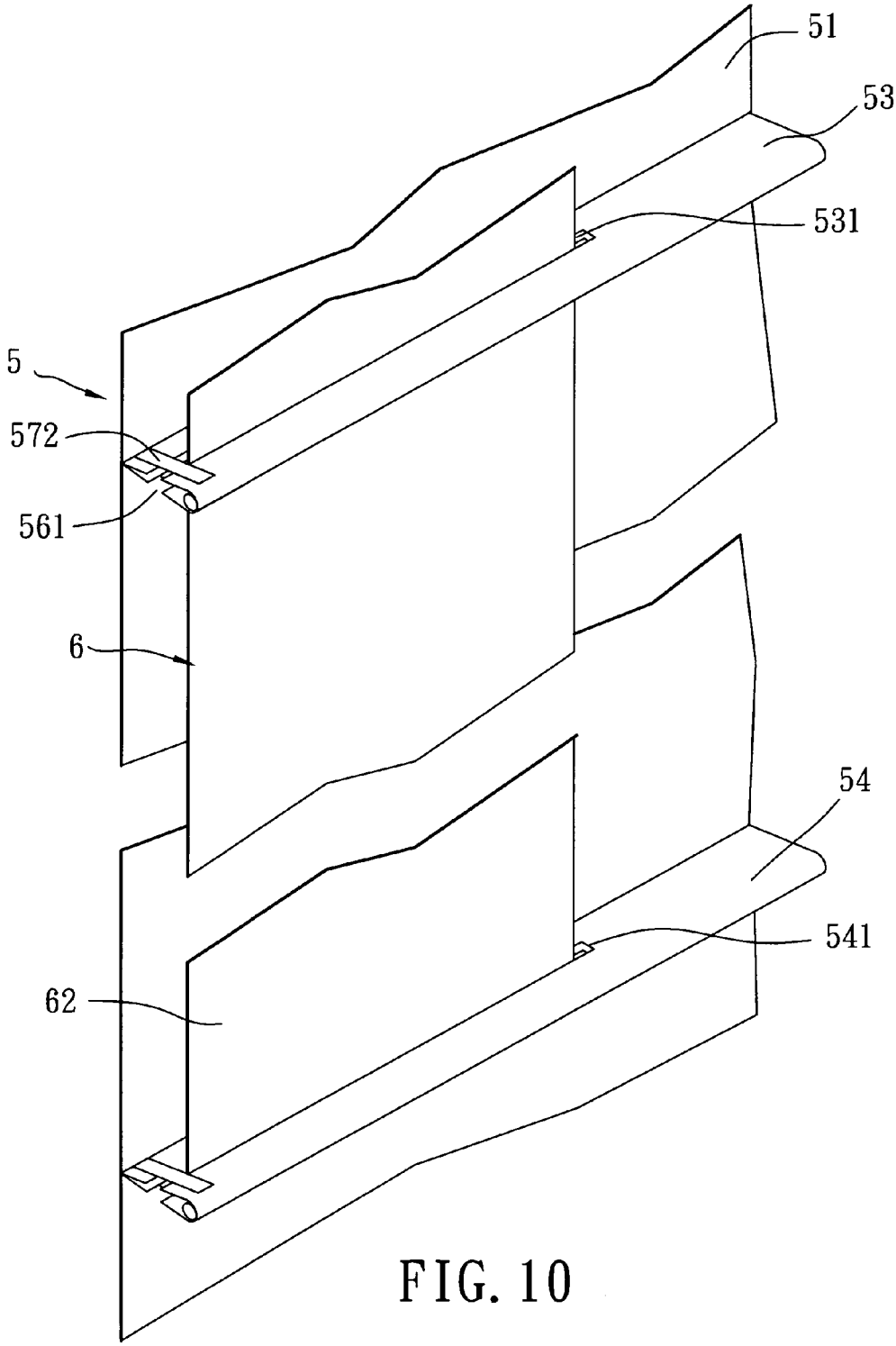
FIG. 10 is a fragmentary perspective view of the roman curtain of the second preferred embodiment.

FIGS. 9 and 10 illustrate a second preferred embodiment of the roman curtain according to the present invention. The second preferred embodiment differs from the first preferred embodiment in the following aspects.

The abutting rod 63 of the winding unit 6 is mounted to the bottom end portion of the winding piece 62. Each of the upper and lower tubes 53, 54 has opposite ends spaced apart horizontally, and each of the upper and lower slots 531, 541 extends to one of the ends of the respective upper and lower tube 53, 54 such that said each of the upper and lower slots 531, 591 has an open end portion 561.

Each of the upper and lower tubes 53, 59 includes a first fastener 571 disposed on the one of the ends thereof, and a second fastener 572 connected to the first fastener 571 to close off the corresponding one of the upper slot 531 and the lower slot 541. Each of the first fasteners 571 and a corresponding one of the second fasteners 572 form a hook-and-loop fastener assembly. In some embodiments, each of the upper and lower tubes 53, 54 includes a pair of first fasteners 571 disposed on the one of the ends of said each of the upper and lower tubes 53, 54 on upper and lower surfaces thereof, and a pair of second fasteners 572 connected respectively to the first fasteners 571. In this embodiment, each of the first fasteners 571 is a loop fastener, and each of the second fasteners 572 is a hook fastener. With such a configuration, the winding piece 62 can be easily removed from the upper and lower slots 531, 591 by disconnecting the first and second fasteners 571, 572, such that the covering portion 51 of the curtain unit 5, as well as the winding piece 62 itself, can be easily removed for cleaning or replacement.

Figure 11:
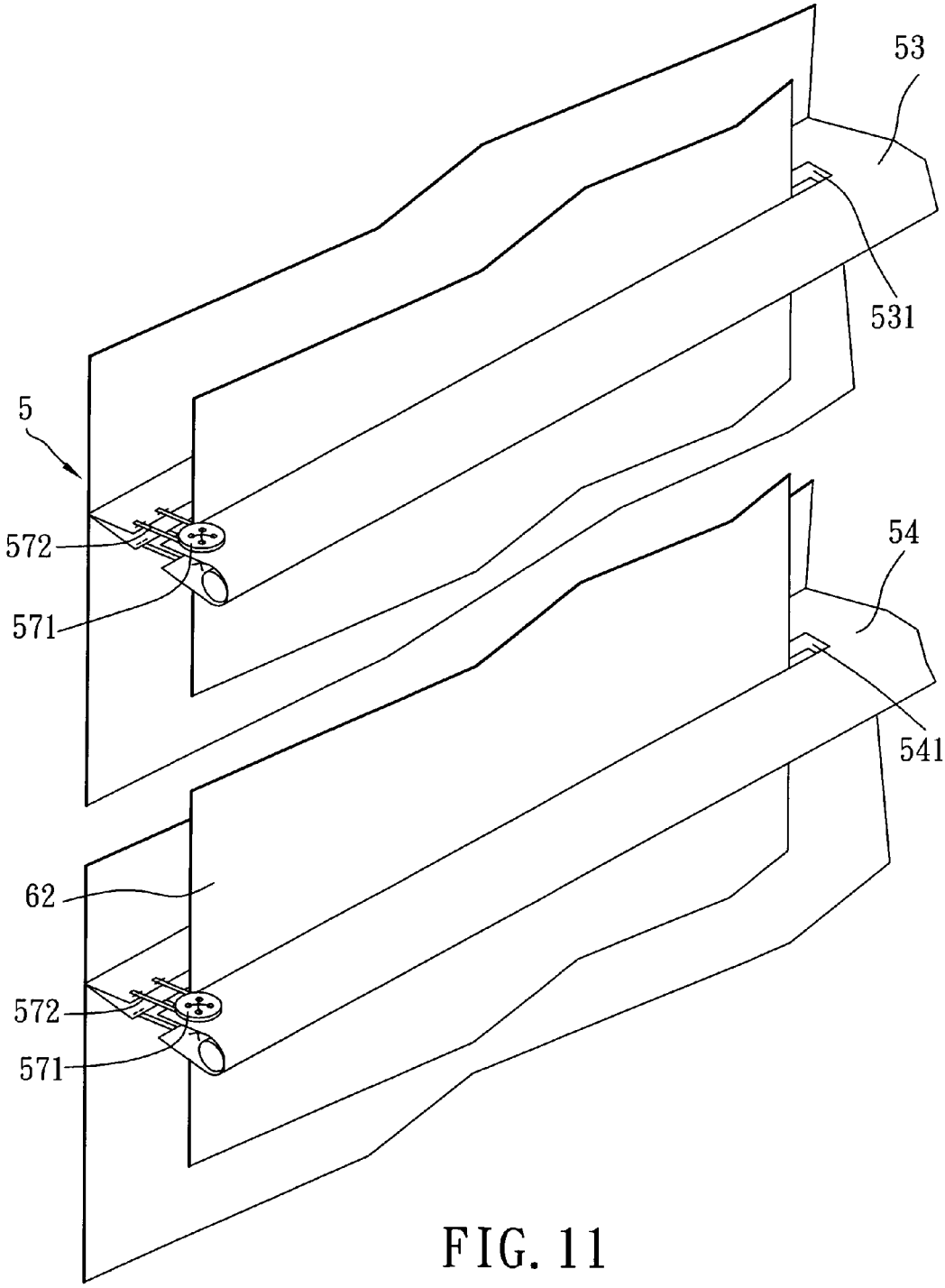
FIG. 11 is a fragmentary perspective view of a roman curtain according to a third preferred embodiment of the present invention.

FIG. 11 illustrates a third preferred embodiment of the roman curtain according to the present invention. The third preferred embodiment differs from the second preferred embodiment in the following aspects.

Each of the first fasteners 571 is a button, and each of the second fasteners 572 is a loop attached to a respective one of the upper and lower tubes 53, 54 and which can be looped around the first fastener 571 to connect therewith.

Figure 12:
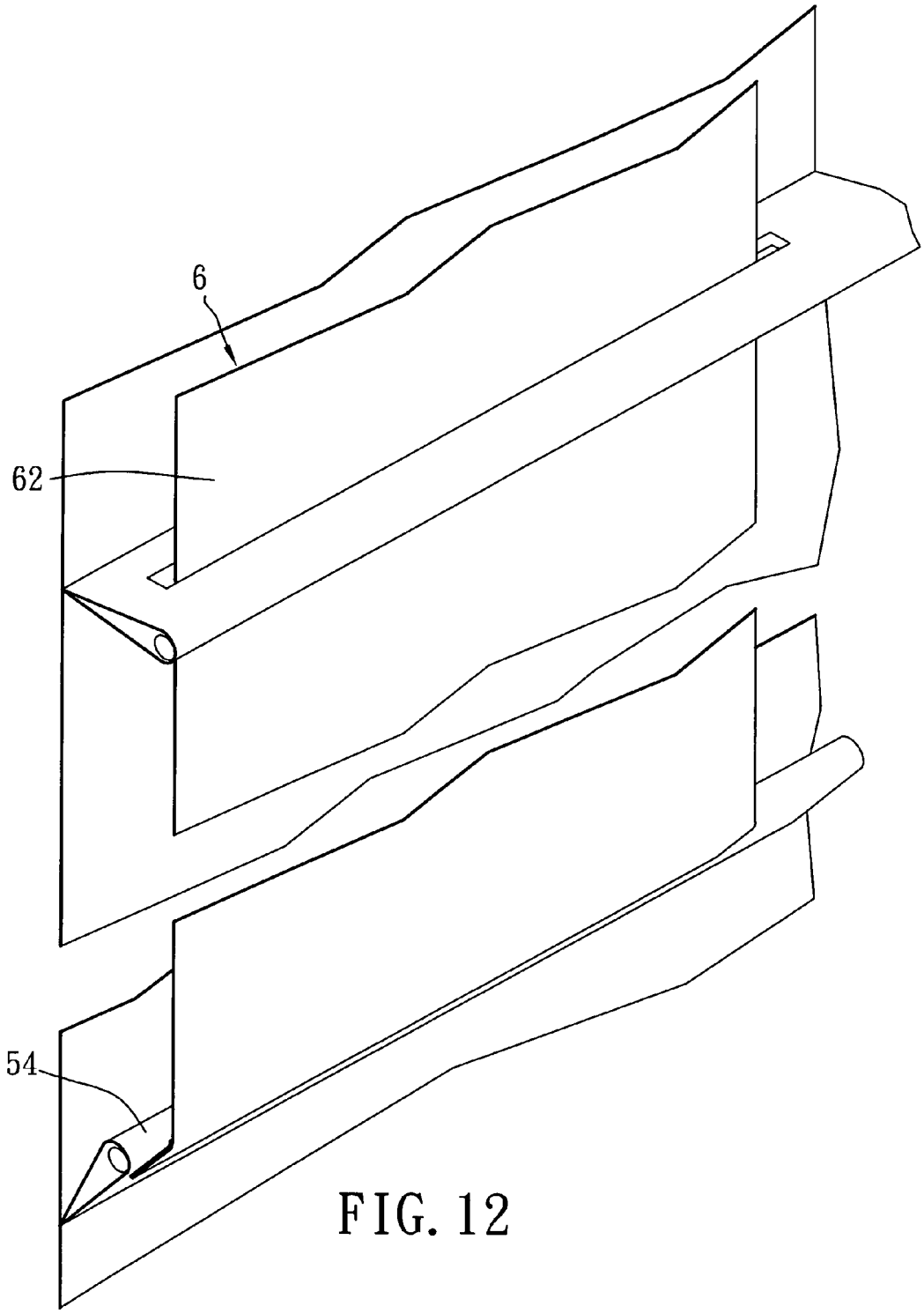
FIG. 12 is a fragmentary perspective view of a roman curtain according to a fourth preferred embodiment of the present invention.
Figure 13:
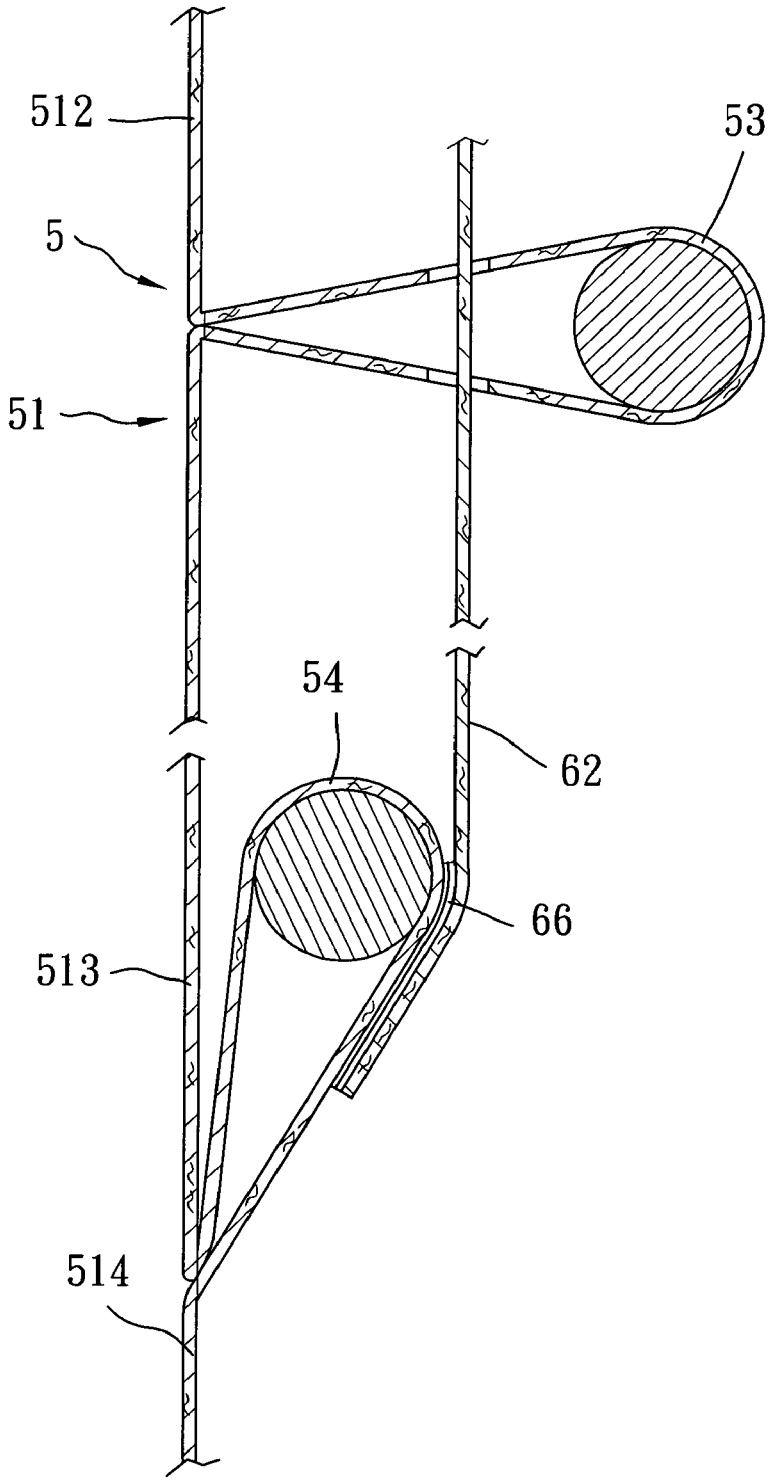
FIG. 13 is a fragmentary sectional side view of the roman curtain of the fourth preferred embodiment.

FIGS. 12 and 13 illustrate a fourth preferred embodiment of the roman curtain according to the present invention. The fourth preferred embodiment differs from the first preferred embodiment in the following aspects.

The bottom end portion of the winding piece 62 of the winding unit 6 is connected separably to the lower tube 54, i.e., the lower tube 54 is not formed with the lower slot 541. The bottom end portion of the winding piece 62 and the lower tube 54 are interconnected by a connecting device 66, which is a hook-and-loop fastener assembly in this embodiment. One of a hook fastener and a loop fastener of the hook-and-loop fastener assembly is disposed on the bottom end portion of the winding piece 62, and the other of the hook fastener and the loop fastener of the hook-and-loop fastener assembly is disposed on the lower tube 54.

When the winding piece 62 is displaced upwardly, the lower tube 54 is pulled up by the bottom end portion of the winding piece 62 such that the third cloth segment 513 is folded. Subsequently, the second cloth segment 512 is folded by the upper tube 53, which is pulled up by the lower tube 54, such that the covering portion 51 can be folded layeredly.

Through this configuration, the winding piece 62 can be easily removed from the lower tube 54 and the upper slot 531 of the upper tube 53 by simply disconnecting the connecting device 66 and slipping the winding piece 62 through the upper slot 531. Hence, the covering portion 51 of the curtain unit 5, as well as the winding piece 62 itself, can be easily removed for cleaning or replacement.

Figure 14:
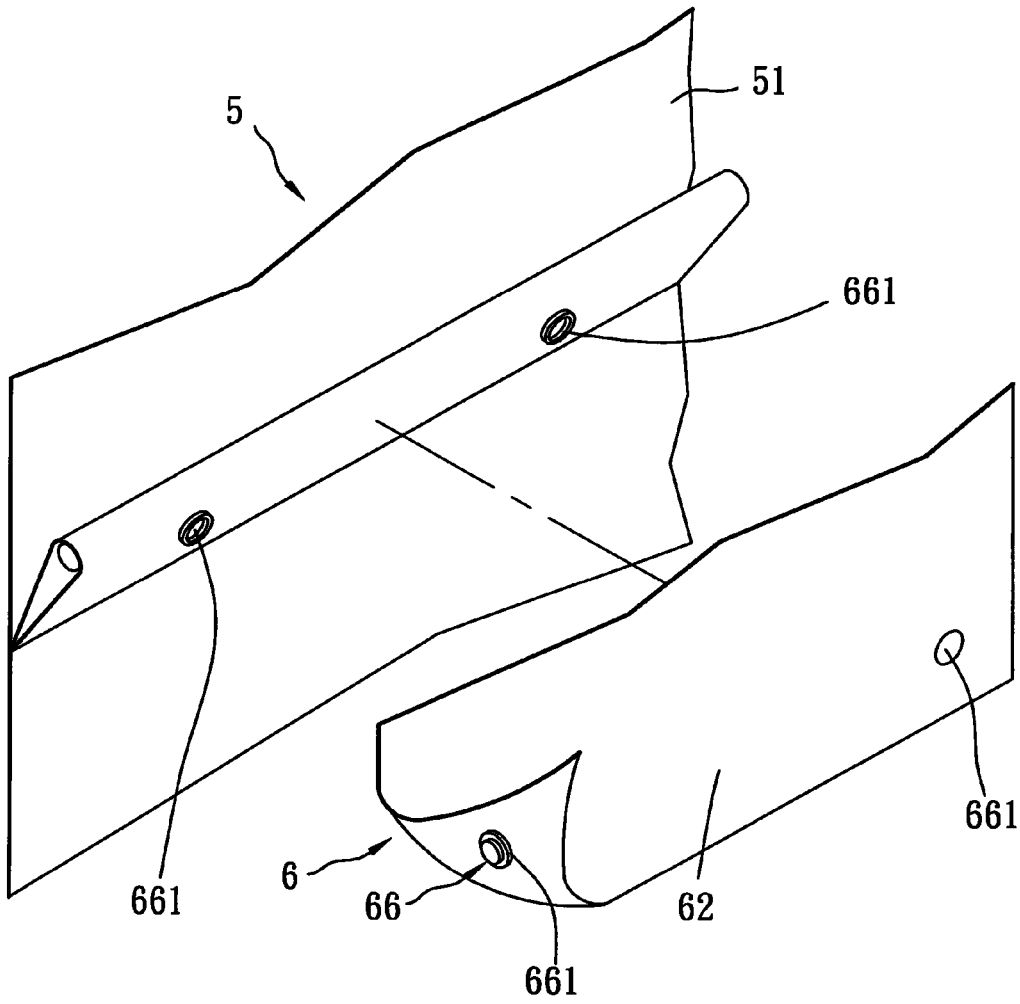
FIG. 14 is a fragmentary exploded perspective view of a roman curtain according to a fifth preferred embodiment of the present invention.

FIG. 14 illustrates a fifth preferred embodiment of the roman curtain according to the present invention. The fifth preferred embodiment differs from the fourth preferred embodiment in the following aspects.

One of a male half and a female half of a snap fastener 661 is disposed on the bottom end portion of the winding piece 62, and the other of the male half and the female half of the snap fastener 661 is disposed on the lower tube 54.

Figure 15:
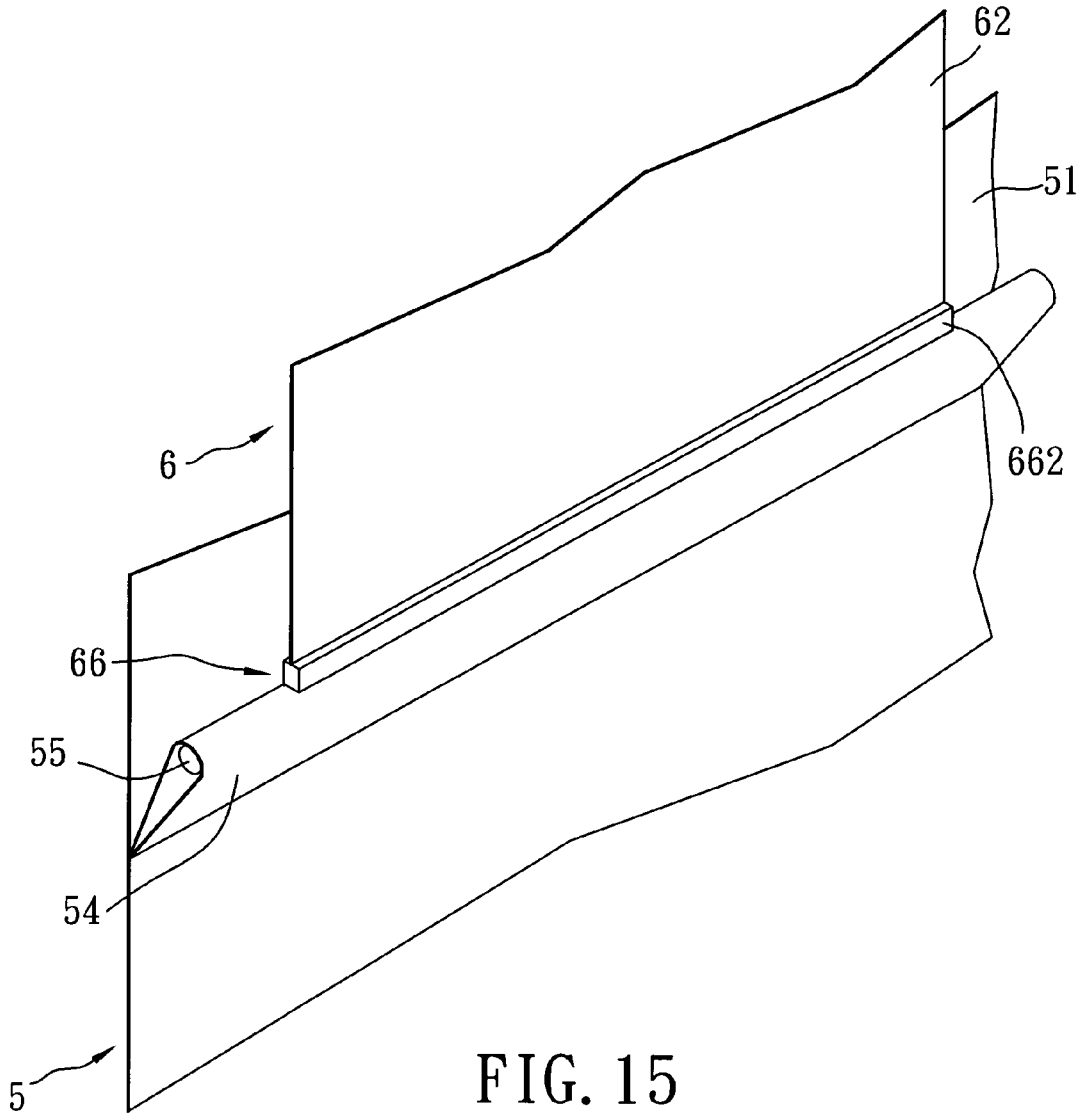
FIG. 15 is a fragmentary perspective view of a roman curtain according to a sixth preferred embodiment of the present invention.

FIG. 15 illustrates a sixth preferred embodiment of the roman curtain according to the present invention. The sixth preferred embodiment differs from the fifth preferred embodiment in the following aspects.

A magnetic component 662 is attached to the bottom end portion of the winding piece 62, and the rod 55 extending into the lower tube 54 is made of a ferromagnetic material such that the magnetic component 662 and the rod 55 are magnetically attracted each other.

Through the configurations of the fifth and sixth embodiments as described above, the winding piece 62 can be easily removed from the lower tube 54. Hence, the covering portion 51 of the curtain unit 5, as well as the winding piece 62 itself, can be easily removed for cleaning or replacement.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A roman curtain adapted for being mounted to a window, said roman curtain comprising:

a curtain unit having a covering portion a top edge portion of which is adapted to be mounted to or in the vicinity of an upper edge of the window and which extends downwardly, an upper tube that extends horizontally and that is disposed on a rear side of said covering portion, a lower tube that extends horizontally and that is disposed on said rear side of said covering portion below and spaced apart vertically from said upper tube, and two rods that extend into said upper and lower tubes respectively, said upper tube being formed with an upper slot; and a winding unit having a winding rod that extends horizontally and that is adapted to be mounted rotatably to or in the vicinity of the upper edge of the window, and a winding piece a top end portion of which is connected to said winding rod and which is able to be wound around said winding rod to be shortened and unwound from said winding rod to be lengthened and to extend downwardly along or next to said rear side of said covering portion of said curtain unit, said winding piece extending through said upper slot from said winding rod and a bottom end portion of said winding piece being restricted in upward movement relative to said lower tube;

wherein when said winding rod is rotated to thereby wind said winding piece therearound, said lower tube is moved upwardly together with said bottom end portion of said winding piece until said lower tube abuts against said upper tube, thereby folding said covering portion of said curtain unit;

wherein said lower tube of said curtain unit is formed with a lower slot for extension of said bottom end portion of said winding piece therethrough, and said winding unit has an abutting rod that is mounted horizontally to said bottom end portion of said winding piece, is larger than said lower slot, and abuts against a bottom surface of said lower tube; and wherein said upper tube has opposite ends spaced apart horizontally, and said upper slot extends to one of said ends of said upper tube;

said lower tube has opposite ends spaced apart horizontally, and said lower slot extends to one of said ends of said lower tube;

each of said upper and lower tubes includes a first fastener disposed on said one of said ends thereof, and a second fastener connected to said first fastener to close off the corresponding one of said upper slot and said lower slot.

2. The roman curtain as claimed in claim 1, wherein each of said first fasteners and a corresponding one of said second fasteners form a hook-and-loop fastener assembly.

3. The roman curtain as claimed in claim 1, wherein each of said first fasteners is a button, and a corresponding one of said second fasteners is a loop attached to a respective one of said upper and lower tubes and which can be looped around said first fastener to connect therewith.

4. The roman curtain as claimed in claim 1, wherein said abutting rod of said winding unit is mounted removably to said bottom end portion of said winding piece.

5. The roman curtain as claimed in claim 1, wherein said bottom end portion of said winding piece of said winding unit is connected separably to said lower tube.

6. The roman curtain as claimed in claim 5, wherein one of a hook fastener and a loop fastener of a hook-and-loop fastener assembly is disposed on said bottom end portion of said winding piece, and the other of said hook fastener and said loop fastener of said hook-and-loop fastener assembly is disposed on said lower tube.

7. The roman curtain as claimed in claim 5, wherein one of a male half and a female half of a snap fastener is disposed on said bottom end portion of said winding piece, and the other of said male half and said female half of said snap fastener is disposed on said lower tube.

8. The roman curtain as claimed in claim 5, wherein a magnetic component is attached to said bottom end portion of said winding piece, and said rod extending into said lower tube is made of a ferromagnetic material.

* * * * *